US007465085B2

(12) United States Patent
McDonough

(10) Patent No.: US 7,465,085 B2
(45) Date of Patent: Dec. 16, 2008

(54) ACTIVITY TIMER FOR MEDITATION

(76) Inventor: Michael P. McDonough, 266 Lorraine Blvd., San Leandro, CA (US) 94577

( * ) Notice: Subject to any disclaimer, the term of this patent is extended or adjusted under 35 U.S.C. 154(b) by 294 days.

(21) Appl. No.: 11/523,622

(22) Filed: Sep. 20, 2006

(65) Prior Publication Data

US 2007/0152799 A1 Jul. 5, 2007

Related U.S. Application Data

(60) Provisional application No. 60/754,675, filed on Dec. 30, 2005.

(51) Int. Cl.
*G04F 1/00* (2006.01)
*G04F 3/00* (2006.01)
*G04F 8/00* (2006.01)

(52) U.S. Cl. ..... 368/98; 368/109

(58) Field of Classification Search ..... 368/89, 368/93–96, 97–99, 107–109
See application file for complete search history.

(56) References Cited

U.S. PATENT DOCUMENTS 2,194,448 A * 3/1940 Rhodes ..... 368/99
2,302,260 A * 11/1942 Rothwell et al. ..... 185/38
D148,336 S 1/1948 Speaker
2,593,905 A * 4/1952 Lux ..... 368/97
2,656,672 A * 10/1953 Webber ..... 368/99
2,736,377 A * 2/1956 Everard ..... 200/38 DA
3,088,270 A * 5/1963 King et al. ..... 368/112
3,501,909 A * 3/1970 Conradt ..... 368/108
D221,976 S 9/1971 Stolarczyk
3,827,232 A * 8/1974 Bassett ..... 368/100
D245,582 S * 8/1977 Mox ..... D10/40
D251,058 S * 2/1979 Danz et al. ..... D10/40
4,451,158 A 5/1984 Selwyn et al.
D276,705 S 12/1984 Oliveri
4,509,864 A * 4/1985 Oellig et al. ..... 368/108

(Continued)

FOREIGN PATENT DOCUMENTS

FR 2 829 591 3/2003

OTHER PUBLICATIONS http://www.balancedlifeproducts.com/$spindb.query.listalll.yogaview.28.~20~2d~20Meditation~20Timers "Balanced Life Products" retrieved on Sep. 25, 2005.

*Primary Examiner*—Vit W Miska
(74) *Attorney, Agent, or Firm*—Richard C. Litman

(57) ABSTRACT

The activity timer for meditation is a timing device having a hollow, oval shaped housing similar in shape and scale to a chicken egg. The housing has a frustoconical base including a flat bottom provided for resting the timer on a flat surface. Translucent radial channels are disposed circumferentially in the housing at predetermined axial distances from each other. A rotary tone selection dial, a rotary time duration selection dial, and a rotary tone volume control are respectively disposed within the radial channels. Logic, control circuitry, audio amplifier and lighting are disposed within the housing. A loudspeaker is located at the top of the housing. The rotary dials are used to select a desired tone, tone volume and timer duration. The device transmits the selected tone signaling the end of a user activity. All rotary dials and selection indicators are illuminated and raised to the touch for ease of use.

12 Claims, 6 Drawing Sheets

U.S. PATENT DOCUMENTS 4,912,586 A * 3/1990 Herron ..... 368/223
5,683,137 A 11/1997 McDonald et al.
5,933,391 A * 8/1999 Uptegraph ..... 368/69
6,570,822 B2 * 5/2003 Stekelenburg ..... 368/107
6,717,888 B2 4/2004 Wilmore
2005/0041534 A1 2/2005 McCarthy

* cited by examiner

ACTIVITY TIMER FOR MEDITATION

CROSS-REFERENCE TO RELATED APPLICATION

This application claims the benefit of U.S. Provisional Patent Application Ser. No. 60/754,675, filed Dec. 30, 2005.

BACKGROUND OF THE INVENTION

1. Field of the Invention

The present invention relates to a timer mechanism. More specifically, the present invention relates to a timer mechanism for controlling duration of a meditation session, yoga session, or the like.

2. Description of the Related Art

Timers prompting a user to perform certain activities at predetermined times are known in the art. The well known "kitchen timer" is one of a number of mechanical timers that produce an audible tone after a predetermined period.

Timers are prevalent in many fields of endeavor, performing as functional tools for time management of activities related to the specific field. The intended goal is to provide an audible signal that, at a minimum, will break through a user's consciousness so that the user can modify or terminate the user's activity at the time the audible signal is presented. In the field of meditation, however, while a traditional "kitchen timer", alarm clock, wrist watch with alarm features, and the like, can be used, it would be more useful and desirable to have a timer with the look, feel and sound of a relaxing environment, and conducive to meditation, yoga, or the like activities. One attempt at providing a meditation timer can be found in French Patent No. FR2829591, issued to Olivier Astic et al. on Mar. 14, 2003. Yet, the Astic invention has a pyramidal shape that is not conducive to easy transporting. Additionally, the Astic invention discloses limited electronic capabilities that do not give the meditator a flexible choice of sounds.

Moreover, an activity timer for meditation should be easy to operate in low lighting, easy to store in a compact space, and easy to transport from place to place.

Thus an activity timer for meditation, and the like, solving the aforementioned problems is desired.

SUMMARY OF THE INVENTION

The activity timer for meditation is a timing device having a hollow, oval shaped housing similar in shape and scale to a chicken egg. The housing has a frustoconical base including a flat bottom provided for resting the timer on a flat surface. Easily illuminated, translucent radial channels are disposed circumferentially in the housing at predetermined axial distances from each other. A rotary tone selection dial, a rotary time duration selection dial, and a rotary tone volume control are disposed respectively within the radial channels. Logic, control circuitry, audio amplifier and lighting are disposed within the housing. A loudspeaker is located at the top of the housing. The rotary dials are used to select a desired tone, tone volume and timer duration. When the timer duration has elapsed, the device transmits the selected tone signaling the end of a meditation session. All rotary dials and selection indicators are illuminated and raised to the touch for ease of use.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
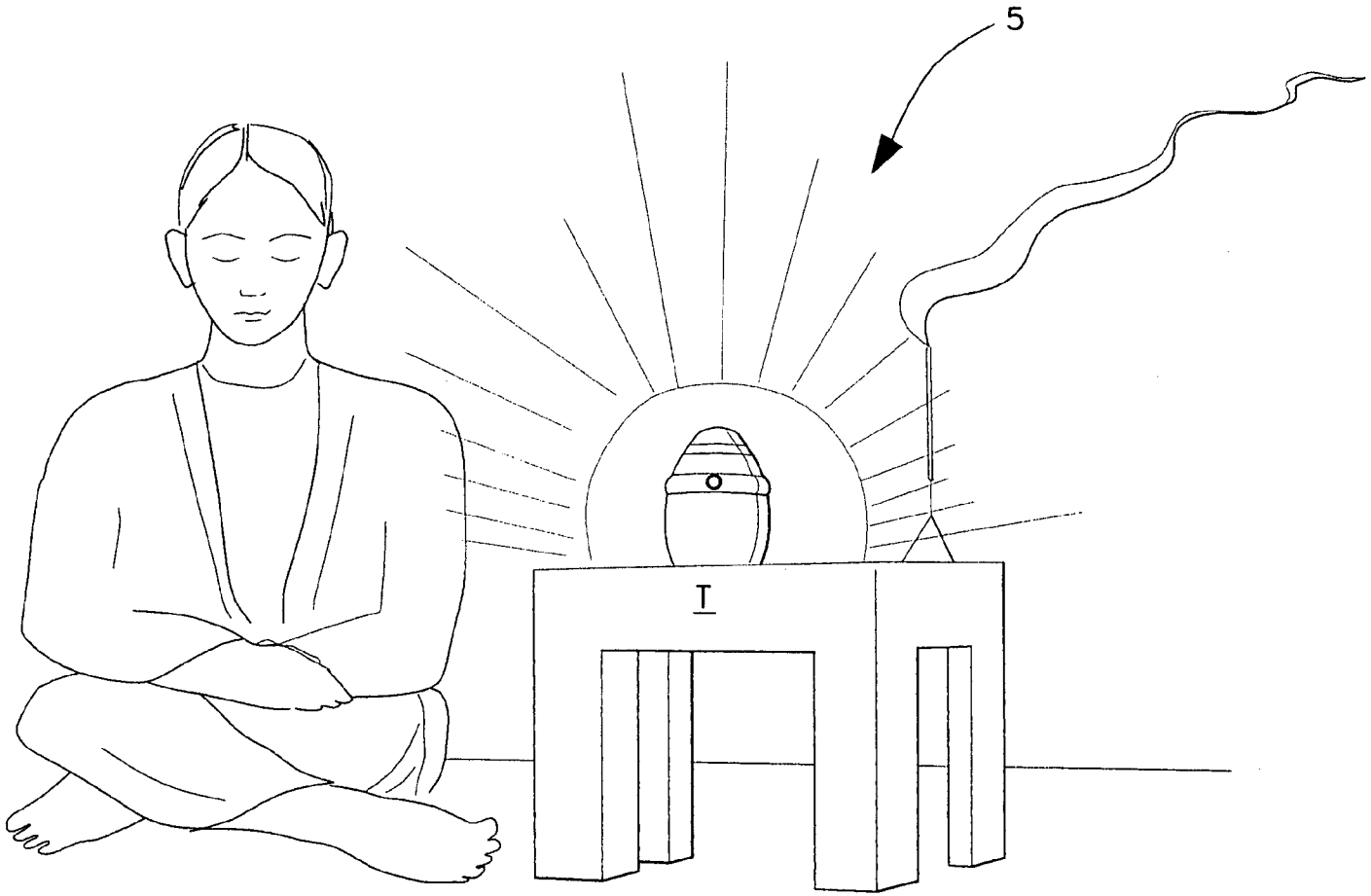
FIG. 1 is an environmental, perspective view of an activity timer for meditation according to the present invention.
Figure 3:
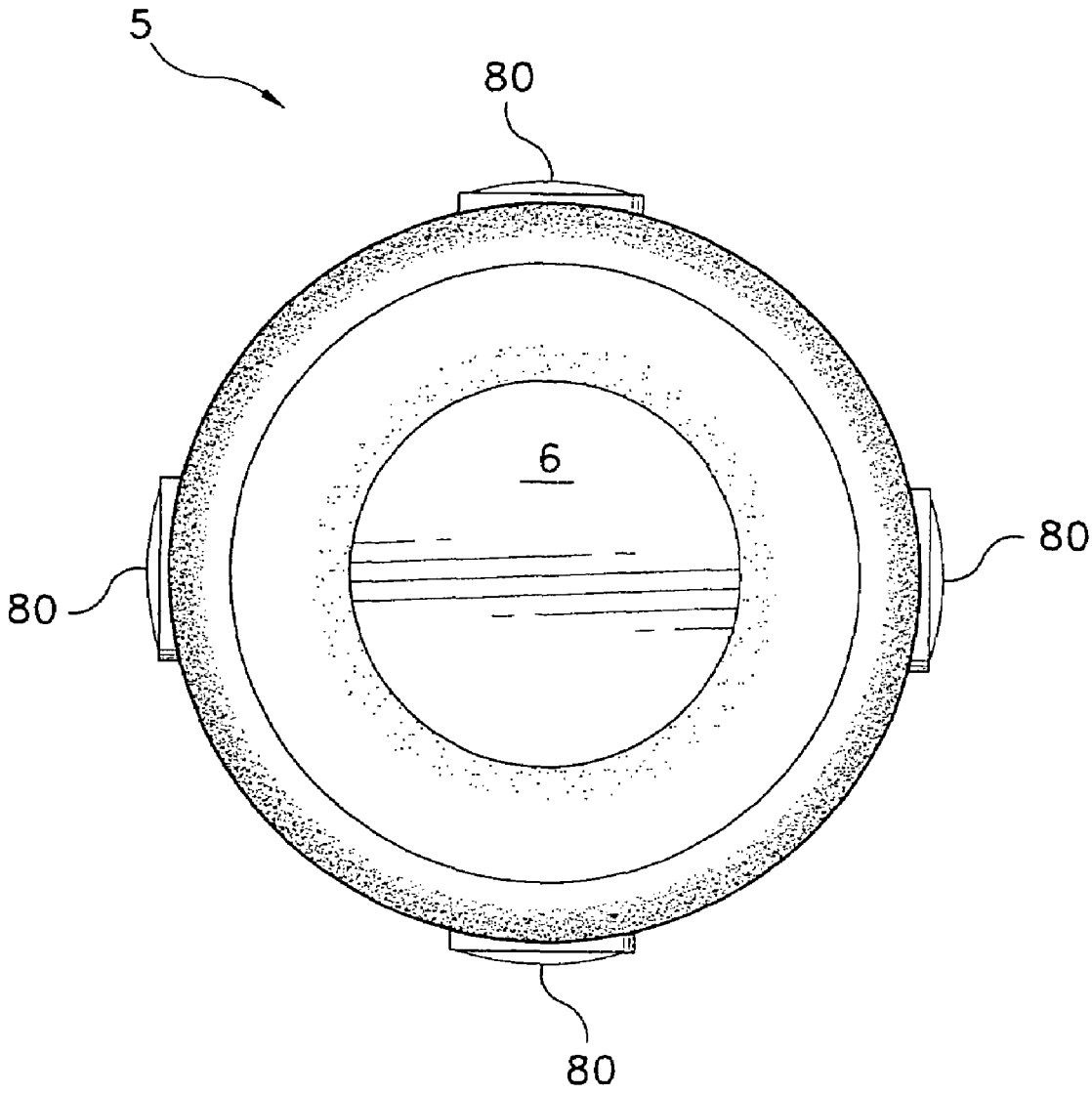
FIG. 3 is a bottom view of the activity timer for meditation, according to the present invention.

As shown in FIGS. 1 and 3, the present invention is an activity timer 5 for meditation, yoga, and the like embodied in a hollow, oval shaped housing 8 of similar shape and scale to a chicken egg, but having a flat surface at the bottom 6 of preferably frustoconical base 7 for resting upright on a substantially flat surface such as table T, a desk, the floor, and the like. The device 5 transmits audible alerts signaling the end of a meditation session.

Figure 2:
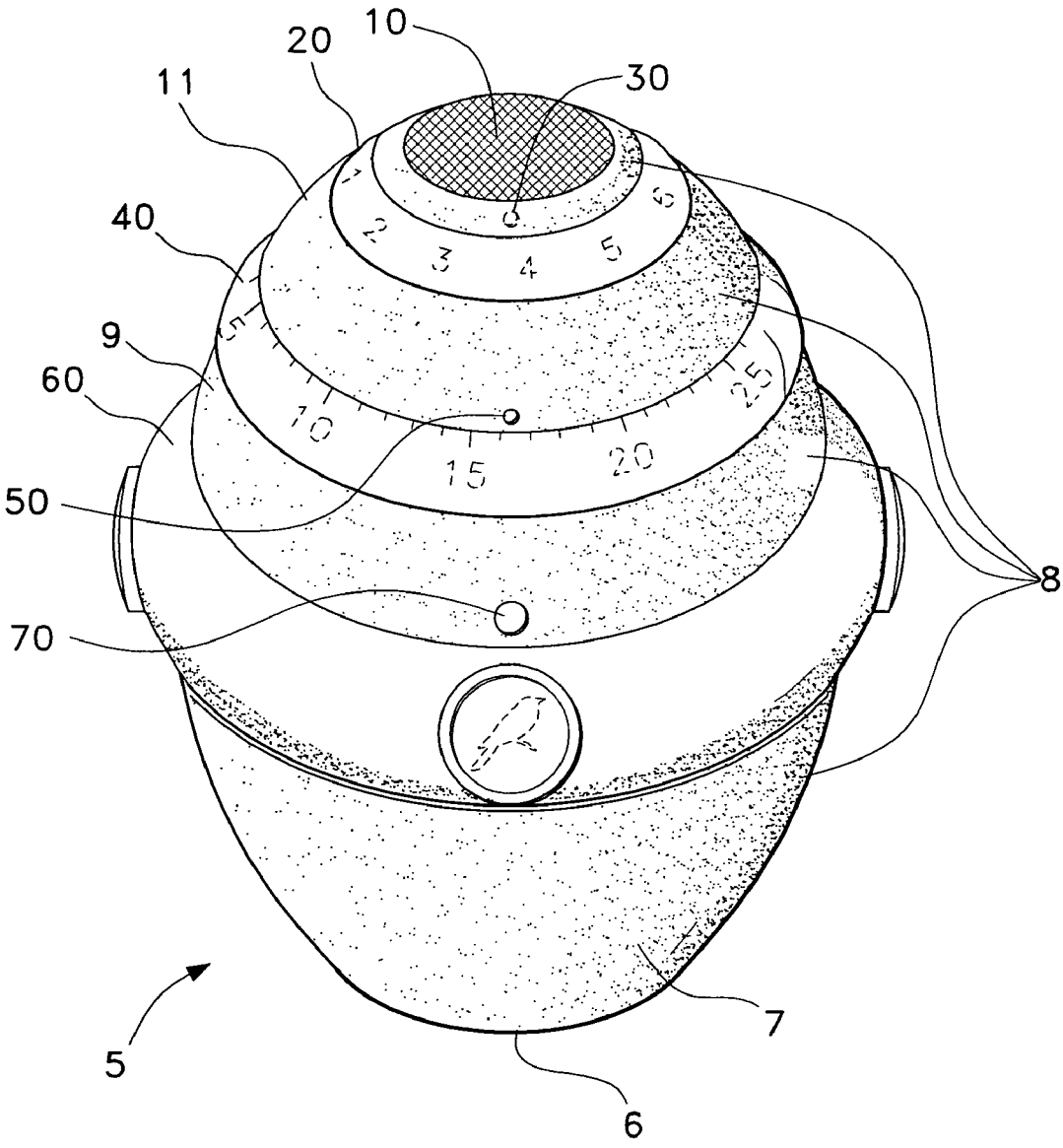
FIG. 2 is a perspective view of the activity timer for meditation, according to the present invention.
Figure 4:
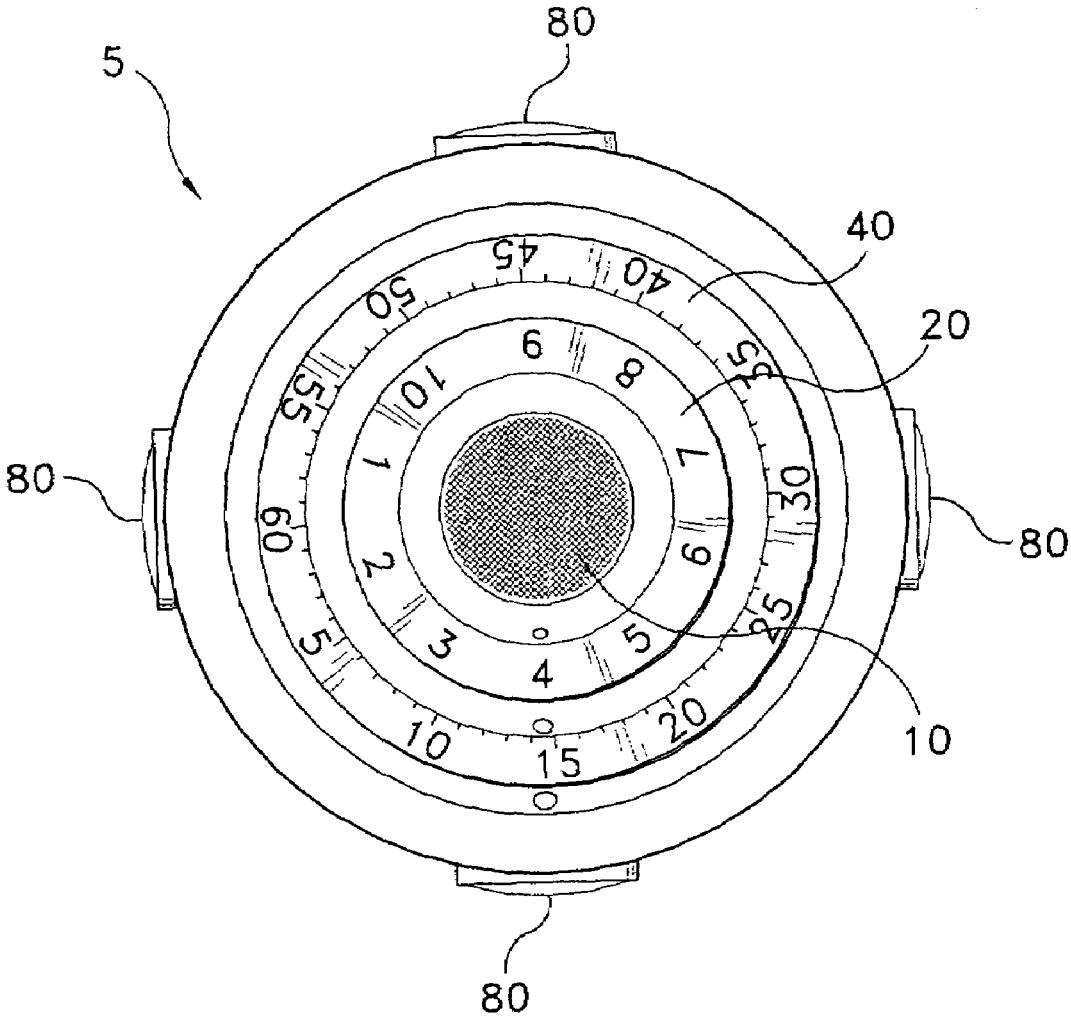
FIG. 4 is a top view of the activity timer for meditation, according to the present invention.
Figure 5:
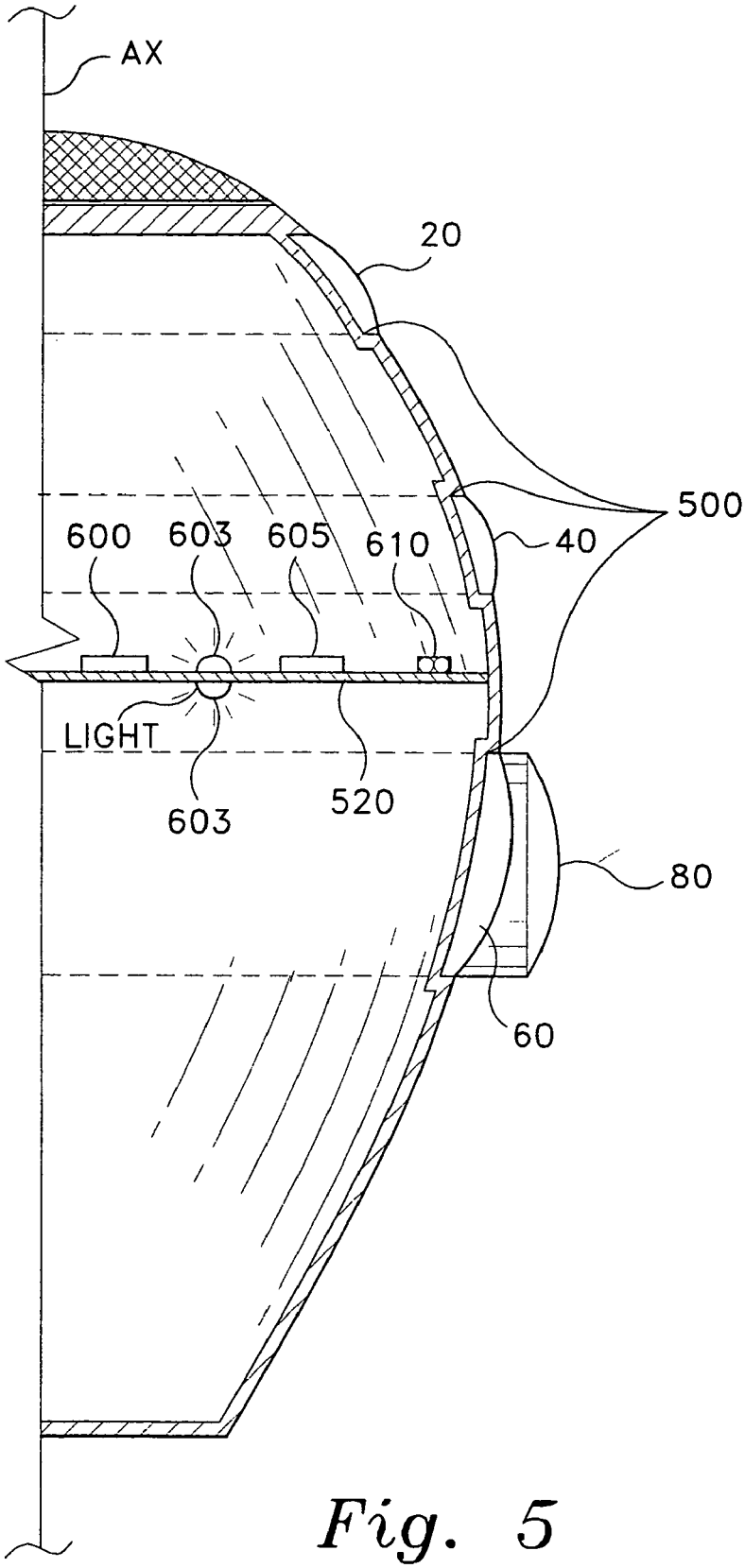
FIG. 5 is a cutaway view of the activity timer for meditation, according to the present invention.

As shown in FIGS. 2, 4 and 5, a loudspeaker 10 is disposed at the top, i.e., at the axially upper most part of top section 11 of housing 8. A rotary volume dial 20 having volume level indicia which may be numbers or other suitable markings, is circumferentially disposed within a first of radial channels 500 of housing 8, preferably in top section 11, while, as shown relative to axial centerline AX, being located axially below the speaker 10. A volume selection indicator 30, being located between the loudspeaker 10 and the volume dial 20 provides alignment capability of the volume dial 20 while a user selects a desired volume of sound that the timer 5 will transmit.

A rotary timer dial 40 is disposed circumferentially within a second of the radial channels 500 of housing 8, preferably in mid section 9, while being located axially below the volume dial 20. The timer dial 40 is calibrated in increments of 5 minutes, ending at 60 minutes.

A time selection indicator 50 is located directly above the timer dial 40, and preferably longitudinally in line with the volume selection indicator 30.

A rotary tone dial 60 is disposed circumferentially within a third of the radial channels 500 of housing 8, below the timer dial 40, and preferably in or near a horizontal plane that intersects the axial center of the housing 8, i.e., between mid section 9 and lower section 7. A tone selection indicator 70 is located directly above the tone dial, and preferably longitudinally in line with the volume selection indicator 30 and the time selection indicator 50.

The tone dial 60 is nearest the base 6, and has preferably raised and illuminated icons 80 representing exemplary sounds such as two gong sounds, a bird singing softly, and a babbling stream. For example, the illuminated icon 80 fully shown in FIG. 2 represents a bird singing softly. As shown in FIG. 3, the tone dial 60 preferably has four of the illuminated icons 80, one for each of the aforementioned exemplary sounds, although it is within the scope of the present invention to include a greater number or lesser number of tone icons corresponding to a greater or lesser number of sounds stored in the meditation timer 5. All rotating dials 20 40 and 60 and select icons 30 50 and 70 are illuminated and raised to the touch for easy use.

Figure 6:
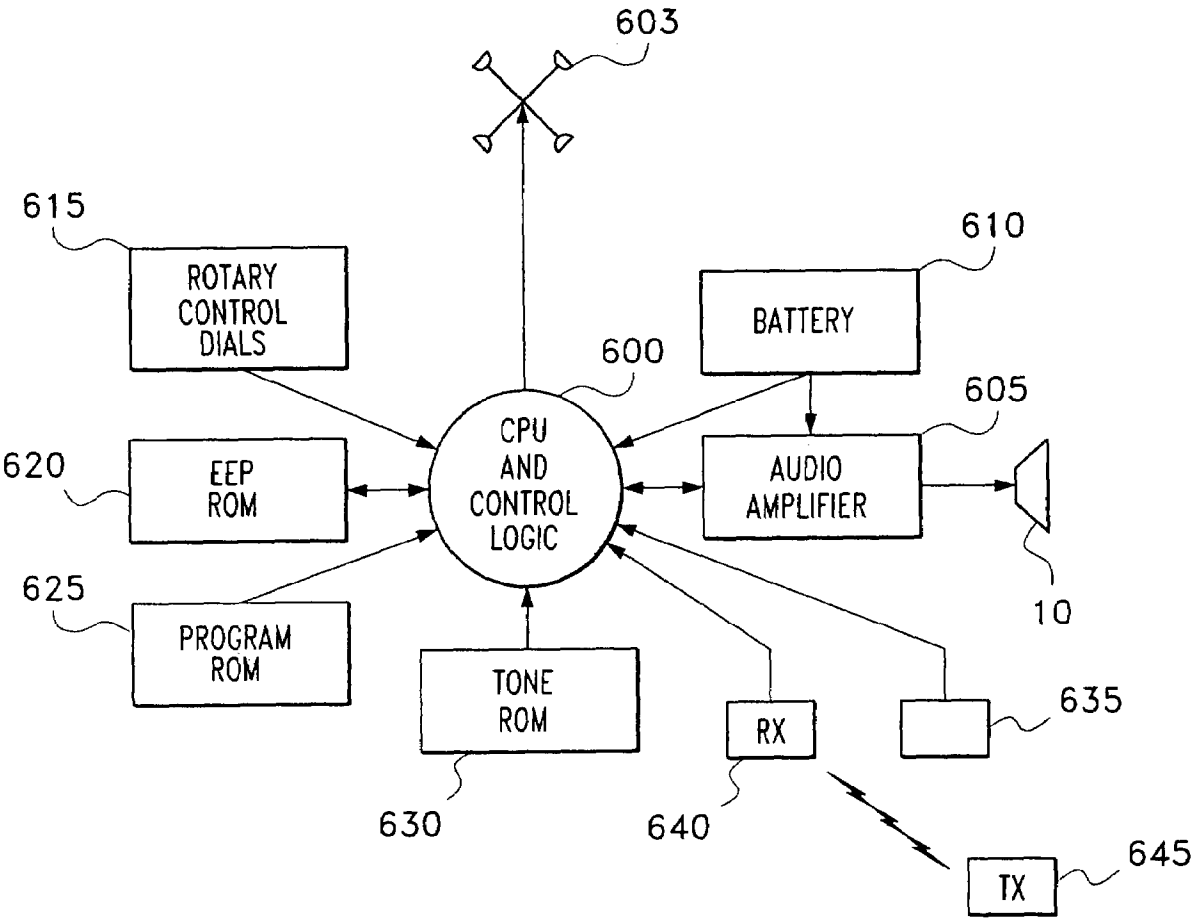
FIG. 6 is a diagrammatic view of the activity timer for meditation control circuitry, according to the present invention.

Circuit board electronics enabling active functionality of the meditation timer may be disposed in any of a variety of configurations so that the circuit board 520 is stably held in place within the hollow housing 8. As shown in FIG. 5, the circuit board 520 is attached horizontally to the inside of the egg shaped housing 8. Logic and control circuitry such as CPU and control 600 populate the circuit board 520. Additionally, illumination of the dial icons 80, numeric and/or non-numeric indicia, and selection indicators 30 50 and 70 may be provided by at least one LED illumination bank 603. Illumination bank 603 may be capable of illuminating a variety of selectable wavelengths, i.e., colors. As shown in FIG. 6, a remote control receiver 640 may be capable of accepting color commands to bank 603 from a remote control transmitter 645. Moreover, other illumination devices, such as traditional bulbs, electroluminescent lighting (EL), and the like are within the scope of the present invention.

As shown in FIG. 6, LED illumination bank 603 is under control of CPU and control logic 600. For example, the CPU 600 may detect that the volume level is zero, then responsively dim or turn off the LED lights 603 in addition to placing all circuitry in a monitor while sleep mode, thus conserving battery power. Conversely when the CPU 600 detects a non-zero volume level, the LED lights 603 could be commanded to turn on along with waking up the other operational features on circuit board 520. Moreover, the remote control receiver 640 may be provided to power up and power down the activity timer 5 responsive to commands from the remote control transmitter 645. Battery 610 powers all circuitry on the circuit board 520.

Audio amplifier 605 is connected to loudspeaker 10 (connection not shown). Tone input and volume control input are received through a connection to CPU and control logic 600. CPU and Logic 600 are also connected to a tone ROM 630 for control of the various tones that may be stored in the tone ROM 630. For example, the exemplary four sounds such as Gong #1, Gong #2, Birds singing softly, and Babbling brook may all be stored in and retrieved from tone ROM 630. Additional and/or replacement tones may be downloaded from an external device, such as e.g., a computer, or recording device through download port 635 (shown in FIG. 6). Download port 635 may be comprised of a wired or a wireless interface. The recording device (not shown) may also be internal and record environmental tones directly to memory such as EEPROM 620. Various logic routines of CPU and control logic 600 reside in and may be executed in Program ROM 625.

For example, the aforementioned illumination control logic may be stored as a subroutine in Program ROM 625. EEPROM 620 has a connection to CPU and control logic 600 and is provided to store various parameters, such as, but not limited to volume settings, tone selection, and timer duration settings.

Rotary control dials, such as rotary volume dial 20, rotary timer dial 40, and rotary tone dial 60 are connected to CPU and control logic 600 (connections not shown). The rotary control dial connections to the CPU 600 may be achieved by printed circuit style conductive channels etched in the interior side wall of housing 8, or the connections may simply be traditional wiring.

The CPU and control logic 600 may be programmed to be responsive to the rotary tone volume dial 20 so that a volume selected by the user is operative to control the loudness of an activated and selected tone.

Moreover, the CPU system 600 may be programmed to be responsive to the rotary time dial 40 so that a time duration selected by the user is operative to control the time duration that must elapse before an activated and selected tone is played through loudspeaker 10. Additionally a predetermined delay before the timer begins counting the user selected time duration may be provided to allow the user to position him/herself before commencement of the activity to be timed.

Additionally, CPU system 600 may be programmed to be responsive to the rotary tone dial 60 so that a particular tone selection dialed in by the user is operative to select one of the aforementioned exemplary tones to be played back after the time duration has elapsed.

The CPU and control logic 600 of the present invention provides increased flexibility of choice in type of rotary control dials that may be employed in the activity timer for meditation 5. For example, rotary control dials 20 40 and 60 may all be physical contact or magnetic switches, in which case the computer (CPU) 600 reads and interprets the switch configuration, or the rotary controls 20 40 and 60 may be variable resistors, i.e., potentiometers, in which case the CPU 600 reads resistance values, and translates the resistance values to a particular function of a corresponding dial setting, i.e., volume setting, tone selection, and time duration setting.

It is to be understood that the present invention is not limited to the embodiment described above, but encompasses any and all embodiments within the scope of the following claims.

I claim:

1. An activity timer, comprising:

a hollow oval shaped housing;

the housing having a frustoconical base including a flat bottom provided for resting the timer on a flat surface;

a loudspeaker disposed at a top of the housing;

a rotary volume dial having volume level indicia and being circumferentially disposed within a first radial channel located in a top section of the housing;

a volume selection indicator being located between the loudspeaker and the volume dial;

a rotary timer dial having time duration indicia and being circumferentially disposed within a second radial channel which is located in a mid section of the housing, axially below the rotary volume dial;

a time selection indicator being located directly above the timer dial and longitudinally in line with the volume selection indicator;

a rotary tone dial having a plurality of tone selection icons disposed along a circumference, while being circumferentially disposed within a third radial channel located in or near a horizontal plane that intersects the axial center of the housing;

a rotary tone selection indicator located directly above the tone dial and longitudinally in line with the volume and time selection indicators;

first logic and control circuitry disposed within the housing and responsive to the rotary tone volume dial whereby a selected volume controls the loudness of the activated selected tone;

second logic and control circuitry disposed within the housing and responsive to the rotary timer dial whereby the selected tone is activated after a selected time duration has elapsed;

third logic and control circuitry disposed within the housing and responsive to the rotary tone dial whereby a selected tone may be activated;

an amplifier disposed within the housing having an output connected to the speaker and control and tone inputs connected to the first and third logic and control circuitry, respectively;

wherein the selected activated tone is played through the loudspeaker at the selected volume to a user after the selected time duration has elapsed.

2. The activity timer according to claim 1, further comprising:

the first, second and third radial channels being translucent;

the rotary tone dial being translucent and comprising a rotary tone selection potentiometer;

wherein when a specific one of the plurality of tone selection icons is lined up with the tone selection indicator, a specific associated tone is selected for playback.

3. The activity timer according to claim 2, further comprising:

rotary timer dial being translucent and comprising a rotary time duration selection potentiometer;

wherein when a specific one of the time duration indicia is lined up with the time duration selection indicator, a specific associated time duration is selected for countdown before the specific associated tone is activated.

4. The activity timer according to claim 3, further comprising:

rotary volume dial being translucent and comprising a rotary volume selection potentiometer;

wherein when a specific one of the volume level indicia is lined up with the volume selection indicator, a specific associated volume is selected for playback of the specific associated tone.

5. The activity timer according to claim 1, further comprising:

the volume selection indicator being translucent;

the time selection indicator being translucent;

the tone selection icons being translucent; and, the rotary tone selection indicator being translucent.

6. The activity timer according to claim 2, further comprising:

illumination means disposed within the housing so that when powered up, the translucent dial icons, the indicia and the selection icons are illuminated for ease of use under low lighting conditions.

7. The activity timer according to claim 1, further comprising: downloading logic, control circuitry and port having the capability of downloading tones from an external device to the activity timer.

8. The activity timer according to claim 1, further comprising: an internal recording device capable of recording environmental tones directly to memory of the activity timer, wherein the environmental tones may be user selectable for playback by the activity timer.

9. The activity timer according to claim 1, further comprising: a remote control receiver capable of accepting remote control commands to power up and power down the activity timer.

10. The activity timer according to claim 6, wherein the means for illumination further comprises means for selection of an illumination color.

11. The activity timer according to claim 10, wherein the means for selection of an illumination color further comprises remote control receiving means for receiving an illumination color command from a remote control transmitter.

12. The activity timer according to claim 11, further comprising: the remote control receiving means being capable of accepting remote control commands to power up and power down the activity timer; and, the remote control transmitter being capable of transmitting the power up and power down commands to the activity timer.

* * * * *